United States Patent [19]

Bush et al.

[11] Patent Number: 4,778,085

[45] Date of Patent: Oct. 18, 1988

[54] PERISTALTIC FLUID DISPENSER

[75] Inventors: Lee W. Bush, Chesterfield; George A. Rauh, Manchester, both of Mo.

[73] Assignee: Calgon Corporation, Pittsburgh, Pa.

[21] Appl. No.: 873,552

[22] Filed: Jun. 12, 1986

[51] Int. Cl.[4] ..... B65D 37/00

[52] U.S. Cl. ..... 222/207; 222/214; 222/438

[58] Field of Search ..... 222/180–181, 222/185, 206–207, 212, 214, 215, 380, 494, 435, 438

[56] References Cited

U.S. PATENT DOCUMENTS

| | | | |
|---|---|---|---|
| 3,870,201 | 3/1975 | Asplund | 222/207 |
| 4,130,224 | 12/1978 | Norman et al. | 222/185 |
| 4,256,242 | 3/1981 | Christine | 222/207 |
| 4,349,133 | 9/1982 | Christine | 222/183 |
| 4,394,938 | 7/1983 | Frassanito | 222/207 |
| 4,461,445 | 7/1984 | Williamson et al. | 222/181 X |
| 4,463,876 | 8/1984 | Swallert | 222/94 |
| 4,515,294 | 5/1985 | Udall | 222/207 X |
| 4,621,749 | 11/1986 | Kanfer | 222/153 |

*Primary Examiner*—Michael S. Huppert

*Attorney, Agent, or Firm*—W. C. Mitchell; M. C. Sudol, Jr.

[57] ABSTRACT

A peristaltic apparatus for dispensing a fluid, which contains a mounting plate, a container support/anvil connected to the mounting plate, a rigid container for holding the fluid to be dispensed, a flexible dispensing tube which is connected to the bottom of the container and which contains a check valve, a housing which encloses the container support and dispensing tube and an actuator which integrally contains a flexible spring bar which exerts a peristaltic force on the flexible tube, thereby forcing fluid from the dispenser.

1 Claim, 6 Drawing Sheets

PERISTALTIC FLUID DISPENSER

BACKGROUND OF THE INVENTION

This invention relates to peristaltic fluid dispensers, in particular for dispensing liquid detergents, soaps and germicides. A need has long existed for a dispenser that would release a measured quantity of fluid which is simple, reliable, inexpensive and easy to assemble and operate.

Therefore, it is an object of this invention to release a measured amount of soap, detergent, germicide or other liquid or semi-solid material (hereinafter termed "fluid") in response to a displacing motion.

It is a further object of this invention that a predetermined quantity of fluid be released from the dispenser upon each instance of use.

U.S. Pat. No. 4,130,224 describes a viscous liquid dispenser which is operated by pulling a lever arm which in turn compresses a resilient flexible tube, thereby squeezing a fluid from the dispenser. U.S. Pat. No. 4,256,242 describes a dispenser which comprises a base portion and a hinged mounting cover, which additionally uses a collapsible bag or package for holding the fluid to be dispensed and an operating lever or handle for actuating the dispenser. The operating lever, when pulled, squeezes fluid from a flexible tube by pinching the tube between the lever and a roller. U.S. Pat. No. 4,349,133 describes a dispenser which utilizes an accordian-type reservoir bag. An operating lever, when pulled, forces fluid from a flexible tube. The lever is returned to its initial position by a spring.

DETAILED DESCRIPTION OF THE INVENTION

Figure 1:
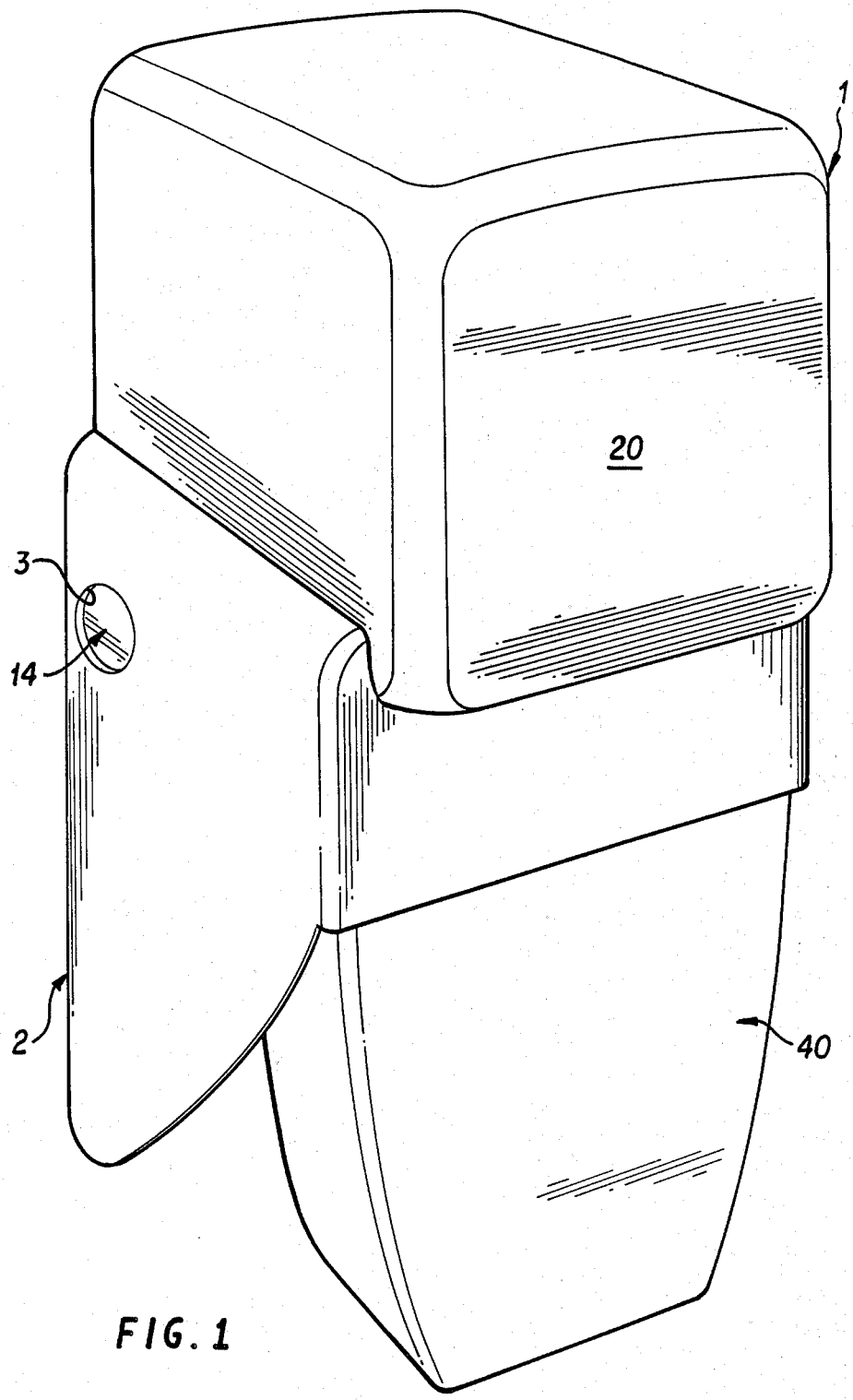
FIG. 1 is a perspective view of the dispenser of the present invention.

The instant invention is directed to a peristaltic apparatus for dispensing a fluid, which comprises:

(a) a mounting plate;

(b) a container support which is removably connected to said mounting plate and which has an anvil affixed thereto;

(c) a rigid container for holding said fluid to be dispensed, wherein said container rests on said container support;

(d) a flexible dispensing tube which is connected to and in fluid communication with said container, wherein said dispensing tube is positioned adjacent to said anvil, and wherein said dispensing tube contains a valve means which is operatively connected thereto;

(e) a housing which is removably connected to said container support and which encloses said container support and said dispensing tube; and (f) an activating means which integrally contains a flexible peristaltic bar, wherein said activating means is pivotally connected to said housing so as to place said flexible peristaltic bar in contact with said flexible tube opposite said anvil.

A more complete picture of the instant invention may be obtained by reference to the drawings. Throughout the following description, similar reference numerals refer to similar elements in all figures of the drawings.

FIG. 1 shows a perspective view of the instant peristaltic dispensing apparatus. The dispensing aparatus 1 generally includes a rigid container 20 which serves as a reservoir for the fluid to be dispensed, a housing 2, an activating means 40, a mounting plate (not shown in FIG. 1) and a container support (not shown in FIG. 1).

Figure 4:
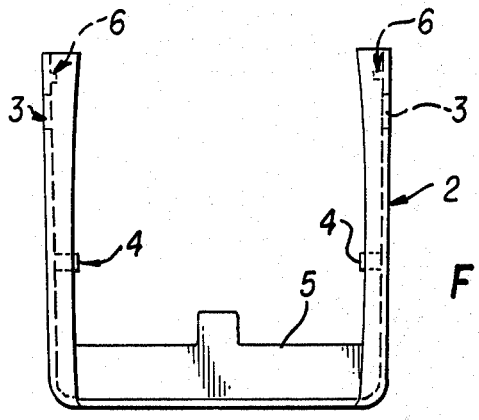
FIG. 4 is a top view of the housing.
Figure 2:
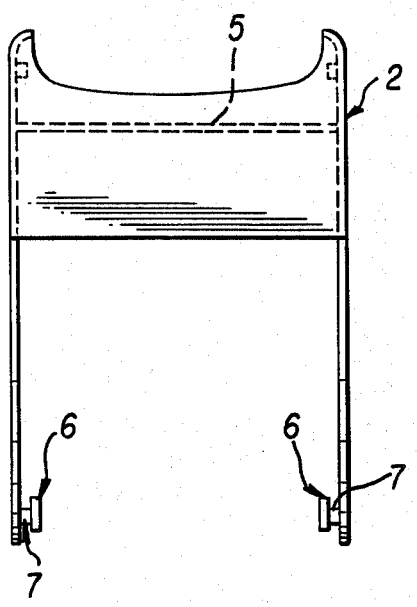
FIG. 2 is front elevational view of the housing.
Figure 3:
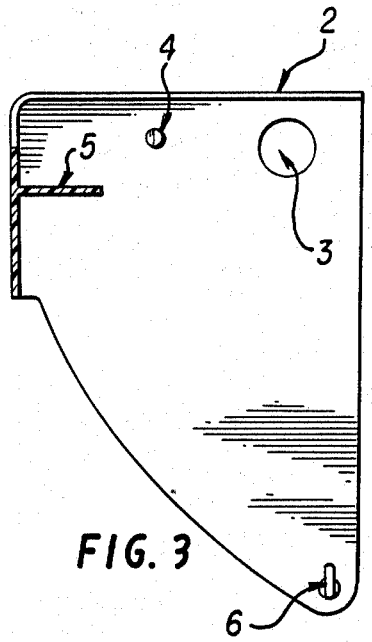
FIG. 3 is a left side elevational view of the housing taken along the center line of FIG. 2.

FIGS. 2, 3, and 4 illustrate the housing 2 in greater detail. The housing forms right and left sides of dispenser 1, and a portion of the front of dispenser 1 below rigid container 20. The right and left side walls of housing 2 contain means for connecting the housing to container support 10 and activating means 40. Container support 10 is connected to housing 2 by key-type pins 6 on the bottom rear sides of housing 2 and by pins on container support 10 which are inserted through orifices in the side walls of housing 2. These orifices are designated as 3 in FIGS. 3 and 4. Thus, key pins 6 on housing 2 are inserted into key orifices 26 on container support 10. This key pin/orifice connecting means enables housing 2 to pivot about a cylindrical portion 7 of key pins 6 when the keys 6 have been inserted through their respective key orifices 26 on container support 10.

Figure 6:
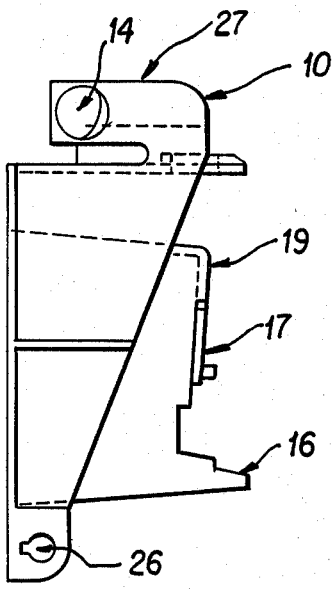
FIG. 6 is a left side elevational view of the container support.

Housing 2 is also connected to container support 10 via latch release pins 14 and latch release orifices 3. (See FIGS. 5, 6 and 7.) Latch release pins 14 are mounted on arms 27 extending from the top of container support 10. In its relaxed state, pins 14 extend through orifices 3 (FIG. 3), locking housing 2 onto container support 10. However, by squeezing latch pins 14 to a position inside orifices 3, housing 2 may be released and rotated about pins 6, thereby exposing container support 10 and dispensing tube 21 without completely removing housing 2 from container support 10. In the absence of a squeezing force, pins 14 extend through orifices 3. This mechanism for opening the dispenser apparatus also facilitates installation and replacement of container 20.

Container 20 rests upon shelf 5 of housing 2 (FIGS. 2, 3 and 4) and supports 13 of container support 10. On the bottom of container 20 (FIG. 8), a flexible dispensing tube 21 is connected. Any connection means may be used. However, it is preferred that dispensing tube 21 be threaded at its top end 24 and connected to container 20 via a correspondingly threaded connecter 23 affixed to neck 28 of container 20. The threaded connection additionally serves to seal the dispensing tube/container interface against leaks. A check valve 25 is affixed to the end of the dispensing tube opposite the end connected to container 20. This check valve 25 prevents flow of the fluid to be dispensed from dispensing tube 21 except during application of a peristaltic force applied by actuating means 40.

Figure 8:
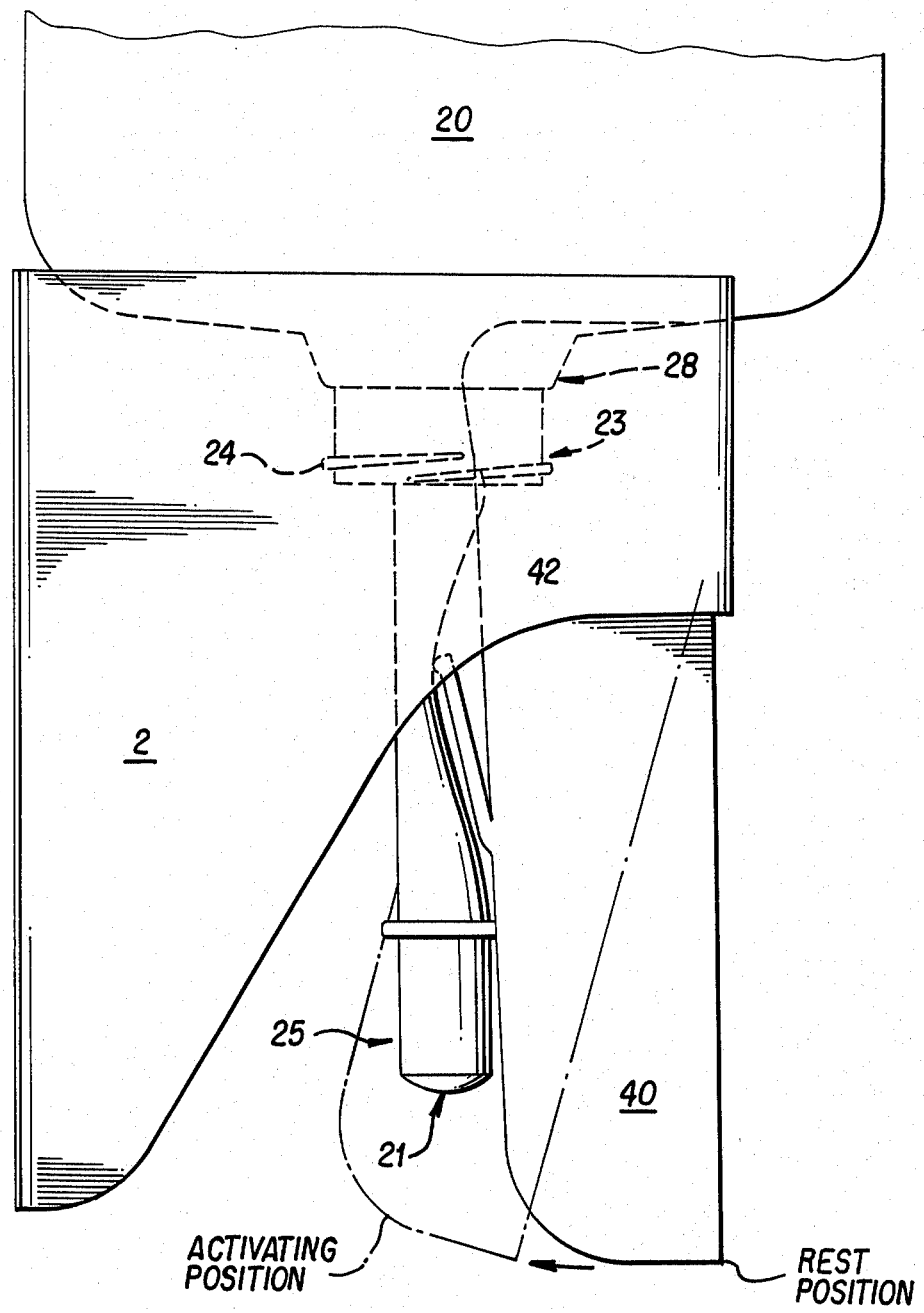
FIG. 8 is a perspective view of the dispensing lever and the dispensing tube, at rest.
Figure 10:
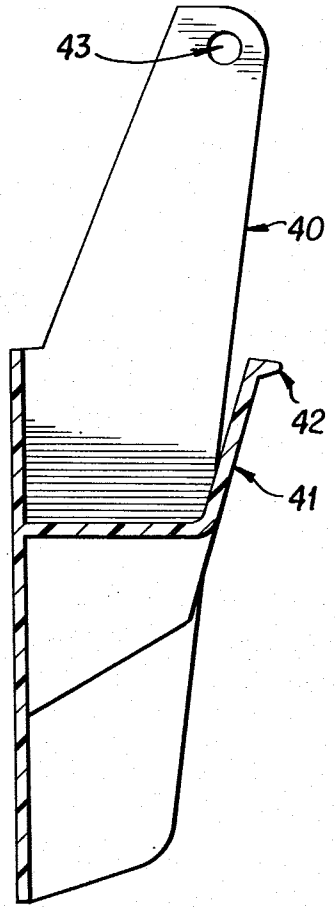
FIG. 10 is a right side elevational view taken along the center line of FIG. 9.
Figure 9:
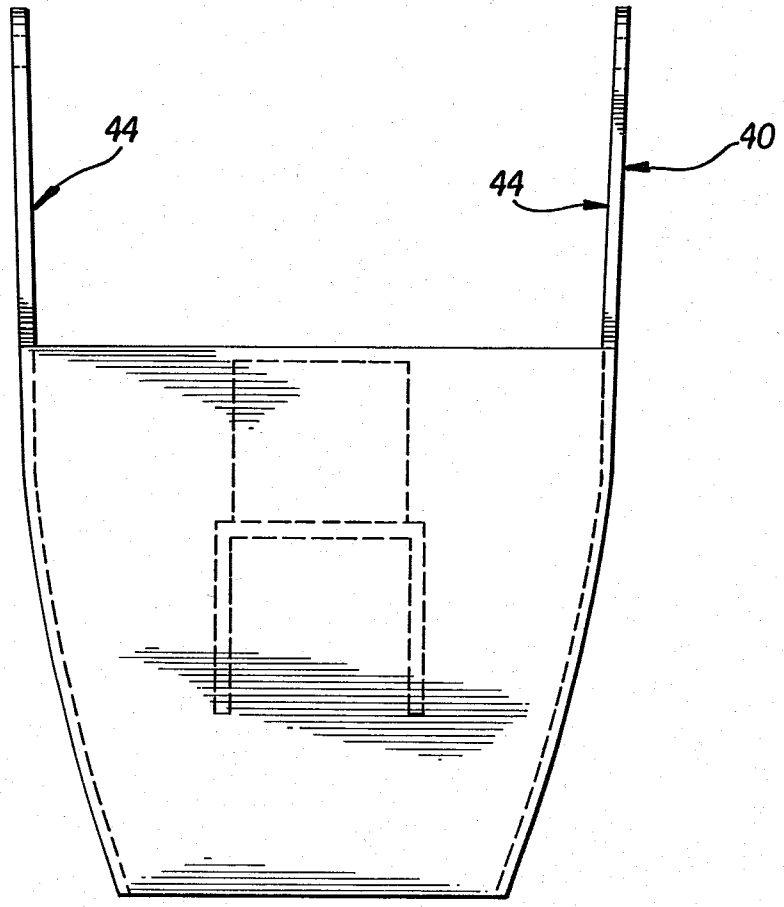
FIG. 9 is a front elevational view of the dispensing lever.

Any flexible material can be used for the dispensing tube. For example, the dispensing tube may be constructed of natural or synthetic rubbers. Flexible thermoplastics suitable for injection molding such as polyethylenevinylacetate copolymers may also be used. The inside diameter of the dispensing tube may vary from about 0.1 inch to about 1.0 inch, preferably from about 0.25 inch to about 1 inch. The most preferred inside tube diameter is about 0.5 inch to about 1 inch. The dispensing tube should have sufficient length to pass between anvil 19 on container support 10 (FIG. 6) and peristaltic bar 41 (FIG. 8). Additionally, when squeezed between peristaltic bar 41 and anvil 19, the dispensing tube should release at least 0.1 cc, preferably about 0.25 to about 5 cc's, of fluid.

Any check valve 25 can be used. For example, a ball-type or an elastic band-type check valve may be used, each of which has an upstream inlet orifice and a downstream outlet orifice. In the former check valve, a ball element is biased toward the inlet orifice by a biasing element, such as a coil spring or an integral spring. In its at-rest state, the fluid above the ball valve rests against the sealed inlet orifice of the check valve. When the dispensing apparatus is actuated by the actuating force of the operator, the flexible peristaltic bar 41 compresses the dispensing tube 21 and squeezes via a peristaltic motion the fluid downward against the closed inlet orifice of check valve 25. This actuating force overcomes the bias of the spring, enabling the fluid to pass through the valve and to discharge from its outlet orifice. In the latter check valve, the outlet orifice is covered by an elastic band. The elasticity of the band prevents fluid from passing through the valve's outlet orifice. When an actuating force is applied, the fluid forces the elastic band away from the outlet orifice, allowing the fluid to pass through the valve. This type of valve is preferred.

Actuating means 40 is connected to housing 2 by hinge pins 4. (See FIGS. 2, 3 and 4.) Thus, upper arms 44 of actuating means 40 are compressed to allow the arms to pass over to the pins 4. These pins are mounted on the side walls of housing 2. The pins 4 are then inserted through pivot pin orifices 43 in actuating means 40. When arms 43 of actuating means 40 are no longer squeezed together, pins 4 extend through orifices 43, thereby affixing actuating means 40 to housing 2 but enabling actuating means 40 to pivot on pins 4. Integrally mounted to actuating means 40 is flexible peristaltic bar 41 with sealing edge 42. In its at-rest position, sealing edge 42 partially compresses dispensing tube 21 against anvil 19. This is shown in FIG. 8 as the "rest" position. While dispensing tube 21 is partially compressed, for example, to an opening of about 20 to about 100 mils, preferably about 40 to about 60 mils, passage of fluid is not completely restricted, and flexible dispensing tube 21 remains filled with fluid from container 20.

The dispensing apparatus 1 is operated by exerting a force, preferably a pushing force, against actuating means 40. This pushing force causes sealing edge 42 of peristaltic bar 41 to compress dispensing tube 21 completely, sealing the dispensing tube into separate upper and lower portions against anvil 19. After the dispensing tube is sealed between sealing edge 42 and anvil 19, peristaltic bar 41 flexes, contacting the lower portion of dispensing tube 21 in a peristaltic manner. This peristaltic action urges the fluid in the lower portion of dispensing tube 21 against check valve 25, overcoming its bias and allowing fluid to be discharged via the outlet orifice of check valve 25. When the pushing force on actuating means 40 ceases, peristaltic bar 41 returns to its original position and sealing edge 42 ceases to seal dispensing tube 21. This enables fluid to flow from container 20 into the lower portion of dispensing tube 21. Since the pushing force is no longer being applied, check valve 25 seals against its inlet orifice, containing the fluid in dispensing tube 21.

The surface of anvil 19 upon which dispensing tube 21 is squeezed must be of sufficient length to allow the dispensing tube to be squeezed over the effective peristaltic length of peristaltic bar 41. Of course, container 20 is provided with an orifice (not shown) to enable atmospheric pressure to be maintained above the fluid level in container 20. This orifice prevents formation of a vacuum above the fluid in container 20 and permits the fluid to flow into dispensing tube 21 via gravity.

One key to the instant dispensing apparatus is the actuating means 40 with integral peristaltic bar 41. This unit is, in essence, a one-piece, injection-moldable thermoplastic spring bar having sufficient elasticity to squeeze shut a flexible dispensing tube without substantially deforming and then, upon continued application of a pushing force, distort in such a manner as to apply peristaltic motion to the dispensing tube, thereby forcing fluid from the tube.

The inventors have found that polyacetal is the preferred flexible thermoplastic material. The polyacetal peristaltic bar should be of sufficient length and thickness to provide at-rest squeezing of the dispensing tube. It should then have sufficient elasticity to first close the dispensing tube against anvil 19 and then deflect to impart the peristaltic motion which drives the fluid below the seal point past check valve 25.

Figure 11:
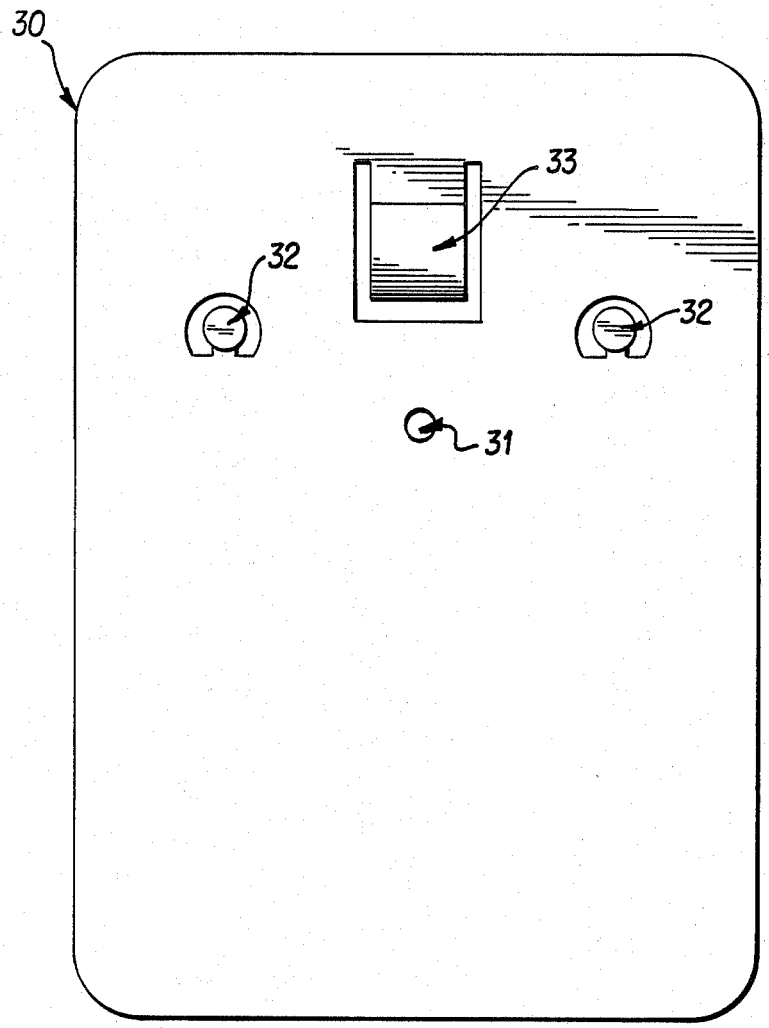
FIG. 11 is a front elevational view of the mounting plate.
Figure 12:
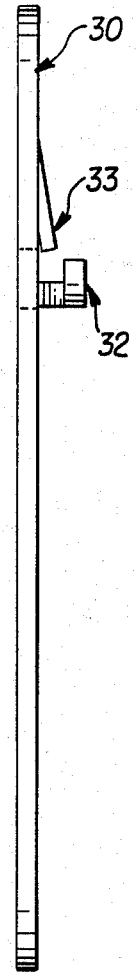
FIG. 12 is a left side elevational view of the mounting plate.

FIGS. 11 and 12 illustrate mounting plate 30. Generally, mounting plate 30 is affixed to a vertical surface via a connecting means such as a screw (not shown). The screw passes through orifice 31 to affix mounting plate 30 to the vertical surface. Mounting plate 30 also includes mounting plate pins 32 and tab lock 33. Container support 10 contains corresponding orifices 11 (FIG. 5) for inserting plate pins 32 and orifice 12 for inserting tab lock 33. Container support 10 first slides over mounting plate pins 32. Then, by pulling container support 10 downward, pins 32 slide into the necks of orifices 11, thereby preventing left or right movement of container support 10 relative to mounting plate 30. Also, tab lock 33 engages a corresponding orifice 12 in container support 10, which precludes container support 10 from moving vertically without first compressing tab lock 33. Thus, mounting plate 30 enables container support 10, housing 2, actuating means 40 and container 20 to be firmly affixed to a vertical surface, such as a wall.

In summary, the instant invention relates to a dispensing apparatus for fluids which is operated by exerting a force on actuating means 40, preferably a pushing force, thereby first squeezing together and sealing off a flexible dispensing tube 21 and then peristaltically forcing fluid in the lower sealed off portion of the flexible dispensing tube through a check valve 25. Actuating means 40, after the pushing force is no longer exerted, returns to its at-rest position due to the elasticity of the integral peristaltic bar 41.

Upon initial operation, the fluid container 20 is filled with the fluid to be dispensed. The fluid to be dispensed flows directly from container 20 into the flexible dispensing tube 21, filling dispensing tube 21 to its capacity. The fluid to be dispensed is held in dispensing tube 21 by a check valve 25 situated at the end of the dispensing tube opposite the end connected to, but in fluid communication with, fluid container 20.

Figure 7:
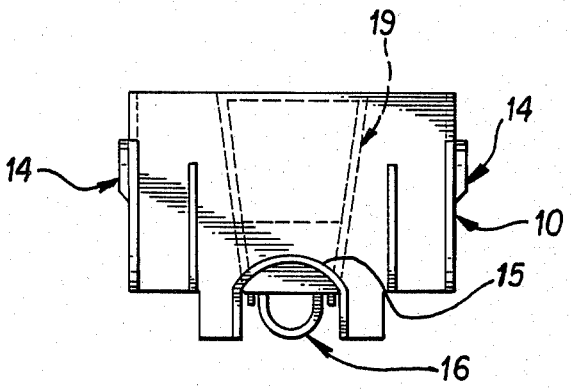
FIG. 7 is a top view of the container support.
Figure 5:
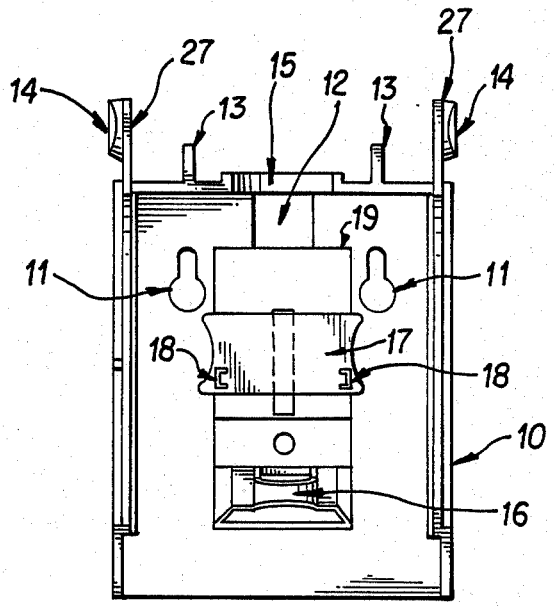
FIG. 5 is a front elevational view of the container support.

Initially, the housing 2 of dispensing apparatus 1 is opened by compressing release pins 14, thereby allowing housing 2 and actuating means 40 to be pivotally lowered from container support 10. The filled container is then inserted onto supports 13 of the container support 10. The flexible dispensing tube 21 is inserted into lower dispensing tube guide 16 and the neck (FIGS. 5, 6 and 7) of container 20 is inserted into an upper dispensing tube guide 15 (FIGS. 5 and 7). The housing/actuating means assembly is then closed by inserting latching pins 14 into orifices 3. This brings the sealing edge 42 of the peristaltic bar 41 into contact with flexible dispensing tube 21. The apparatus is now ready for operation.

Any rigid plastic or thermoplastic material can be used to form the container, the container support and the mounting plate. As noted earlier, however, the integral actuating means/peristaltic bar should be made using polyacetal, as the inventors have found polyacetal to have the most desirable elasticity properties.

As an added feature, the instant apparatus may also comprise a mechanism for regulating the volume of the fluid expelled through check valve 25. For example, sliding volume regulator 17 (FIGS. 5 and 6) may be affixed to anvil 19. Volume regulator 17 contains contact pins 18, which impact peristaltic bar 41 when an actuating force is applied to actuating means 40. By raising or lowering sliding volume regulator 17 on anvil 19, the peristaltic squeezing action exerted on flexible dispensing tube 21 may be regulated. Thus, when sliding regulator 17 is moved toward the bottom of anvil 19, peristaltic contact between peristaltic bar 41 and dispensing tube 21 is increased. By raising regulator 17, peristaltic bar 41 contacts pins 18 earlier, thereby minimizing peristaltic contact between bar 41 and dispensing tube 21.

What is claimed is:

1. A peristaltic apparatus for dispensing a fluid, which consists essentially of:

(a) a mounting plate;

(b) a container support which is removably connected to said mounting plate and which has an anvil affixed thereto;

(c) a rigid container for holding said fluid to be dispensed, wherein said container rests on said container support;

(d) a flexible dispensing tube which is connected to and in fluid communication with said container, wherein said flexible dispensing tube is positioned adjacent to said anvil, and wherein said flexible dispensing tube contains a valve means which is operatively connected thereto;

(e) a housing which is removably connected to said container support and which encloses said container support and said dispensing tube;

(f) a one-piece injection moldable polyacetal actuating means which integrally contains a spring bar which squeezes said flexible dispensing tube shut against said anvil without substantially deforming upon application of an actuating force and which, upon further application of said actuating force, deforms so as to impart a peristaltic force on said flexible dispensing tube in conjunction with said anvil, wherein said actuating means is pivotally connected to said housing so as to place said spring bar in contact with said flexible dispensing tube opposite said anvil, and wherein said spring bar returns said actuating means to its original position after said actuating force ceases; and (g) a volume regulator provided on said anvil and having at least one movable contact pin, wherein said movable contact pin of said volume regulator impacts said peristaltic bar so as to increase or decrease contact between said peristaltic bar and said flexible tube, thereby regulating the quantity of fluid dispensed.

* * * * *